US011082759B2

(12) United States Patent
Hentschel et al.

(10) Patent No.: US 11,082,759 B2
(45) Date of Patent: Aug. 3, 2021

(54) SURROUND FOR PIPELINE INSPECTION EQUIPMENT

(71) Applicant: PURE TECHNOLOGIES LTD., Calgary (CA)

(72) Inventors: Kyle Hentschel, Calgary (CA); Peter O. Paulson, Calgary (CA)

(73) Assignee: PURE TECHNOLOGIES LTD, Calgary (CA)

( * ) Notice: Subject to any disclaimer, the term of this patent is extended or adjusted under 35 U.S.C. 154(b) by 53 days.

(21) Appl. No.: 16/230,358

(22) Filed: Dec. 21, 2018

(65) Prior Publication Data

US 2019/0200108 A1 Jun. 27, 2019

Related U.S. Application Data

(60) Provisional application No. 62/609,918, filed on Dec. 22, 2017.

(51) Int. Cl.
*H04R 1/02* (2006.01)
*H04R 1/08* (2006.01)

(52) U.S. Cl.
CPC ..... *H04R 1/023* (2013.01); *H04R 1/028* (2013.01); *H04R 1/086* (2013.01)

(58) Field of Classification Search
CPC combination set(s) only.
See application file for complete search history.

(56) References Cited

U.S. PATENT DOCUMENTS 5,871,386 A * 2/1999 Bart ..... A63H 15/06 446/443
6,271,145 B1 * 8/2001 Toda ..... B81C 1/00126 438/706
6,402,630 B1 * 6/2002 Tyler ..... A63B 37/0001 446/454

(Continued)

FOREIGN PATENT DOCUMENTS

CN 203777953 * 8/2014

OTHER PUBLICATIONS

Pure Americas Inc., SmartBall Inspection Report of North Beach Force Main, Aug. 23, 2011, pp. 1-49. (Year: 2011).*

*Primary Examiner* — Fan S Tsang
*Assistant Examiner* — Angelica M McKinney
(74) *Attorney, Agent, or Firm* — Barnes & Thornburg LLP

(57) ABSTRACT

A surround for protecting an acoustic device for sending and/or receiving acoustic signals positioned therein from impact as the surround is rolled along an interior surface of a fluid-containing pipeline, the surround comprising: a shell comprising an exterior segment configured to roll along the interior surface, the exterior segment defining at least one acoustic aperture configured to allow the passage of acoustic signals therethrough; and a lattice configured between the exterior segment and the acoustic device, the lattice comprising a plurality of unit cells, each unit cell defining an opening, wherein the plurality of unit cells are interconnected and define a plurality of openings, wherein the plurality of openings allow fluid to move between the interior of the surround and the exterior of the surround and enable the passage of the acoustic signals transmitted and/or received by the acoustic device such that the surround reduces the diminution of the quality and/or strength of the acoustic signals.

16 Claims, 13 Drawing Sheets

(56) References Cited

U.S. PATENT DOCUMENTS

| | | | | |
|---|---|---|---|---|
| 10,150,013 | B2 * | 12/2018 | Paarporn | A63B 43/00 |
| 2008/0204008 | A1 * | 8/2008 | Paulson | G01M 3/246 324/220 |
| 2011/0103189 | A1 * | 5/2011 | Paulson | G01S 11/14 367/89 |
| 2011/0162454 | A1 * | 7/2011 | Paulson | G01N 29/343 73/592 |
| 2016/0027425 | A1 * | 1/2016 | Cook | F28F 1/00 428/221 |
| 2017/0172752 | A1 * | 6/2017 | Adams | A61B 17/7291 |
| 2017/0350241 | A1 * | 12/2017 | Shi | E21B 47/01 |
| 2018/0169865 | A1 * | 6/2018 | Kou | A63H 33/005 |
| 2018/0177064 | A1 * | 6/2018 | van Pol | G01D 11/245 |

* cited by examiner

SURROUND FOR PIPELINE INSPECTION EQUIPMENT

CROSS REFERENCE TO RELATED APPLICATIONS

This application claims the benefit of priority under 35 U.S.C. § 119(e) to U.S. Provisional Patent Application No. 62/609,918, filed Dec. 22, 2017. The disclosure set forth in the referenced application is incorporated herein by reference in its entirety.

TECHNICAL FIELD

The present invention relates to protective structures for protecting pipeline inspection equipment from impact.

BACKGROUND

Equipment to detect pipeline conditions are known and are described in U.S. Pat. No. 8,098,063 (Paulson). Such equipment may include an acoustic sensor or hydrophone to detect sounds that are created at the location of a leak in the pipeline. For example, Singapore patent No. 167514 (Paulson) describes the use of ultrasonic acoustic pulses emitted from the instrument as it rolls through a pipeline. The equipment tends to be quite expensive and prone to damage if not adequately protected.

U.S. Pat. No. 8,098,063 and Singapore patent No. 167514 describe a foam ball which includes ports proximal to the acoustic sensor location for protecting the detection equipment. As shown in FIG. 1, the foam ball or foam surround 1 may have ports 2 to allow the passage of sound into the instrument, and from the instrument into the pipeline fluid for the ultrasonic acoustic pulses.

The use of a foam surround has several disadvantages. The foam itself is a reticulated foam, which includes pores but lacks cell structure. This type of foam has been chosen because it allows the pipeline fluid to displace any air in the foam and thus avoids flotation caused by trapped air. While pores in the reticulated foam surround can be as large as 4 pores per inch, the foam will impede the passage of high frequency sound moving from the pipeline fluid inward toward the instrument, and moving outward from the instrument into the pipeline fluid. The ports described in the patents U.S. Pat. No. 8,098,063 and Singapore patent No. 167514 mitigate the attenuation of acoustic energy reaching and leaving the instrument, however, the provision of ports may introduce unintended effects such as uneven rolling motion when one or more ports contact the surface of the pipeline.

Another disadvantage of the foam surround is that in use, the movement of the instrument and surrounding foam through a flowing pipeline includes the rolling action described in U.S. Pat. No. 8,098,063 but also includes a sliding action produced by the drag of the instrument and surround as the top surface of the foam moves forward in the pipeline fluid. This drag generates an acoustic noise that encumbers the detection of leak sounds by generating a background noise that increases as the velocity of the fluid increases.

Another disadvantage of the foam surround is that the effort required to compress the surround during insertion through a small port on the pipeline can be considerable because a certain minimum foam density is required to maintain a spherical outside surface.

Yet another disadvantage of the foam surround is that it cannot be molded easily into the shape required, and so is typically shaped after the foam is created, making the surround more expensive.

SUMMARY OF THE INVENTION

It is an embodiment of the present disclosure to provide a surround for a pipeline inspection equipment.

According to an embodiment, we disclose a surround comprising a compressible material that has an organized structure that can optimize the passage of sound through the thickness of the surround. In this regard, the surround is configured to allow some parts of the surround to provide open pathways from the equipment to the pipeline fluid, the pathways may be substantially clear from any of the material of the surround, or encounter only a minimum material of the surround.

According to an embodiment, the surround of the present disclosure may avoid the use of the ports that are required to optimize the passage of sound through the thickness of the known surrounds, and therefore provide a smoother rolling action, as there are no ports to interfere with the rolling.

According to an embodiment, the surround of the present disclosure is configured to allow optimum compressibility of the surround.

According to an embodiment, the surround of the present disclosure is configured to provide a rolling contact point that minimizes the acoustic noise caused by the skidding or slipping of the surround along the interior of the pipeline.

According to an embodiment, the present disclosure relates to a surround for protecting an acoustic device for sending and/or receiving acoustic signals positioned therein from impact as the surround is rolled along an interior surface of a fluid-containing pipeline, the surround comprising:

- a shell comprising an exterior segment configured to roll along the interior surface, the exterior segment defining at least one acoustic aperture configured to allow the passage of acoustic signals therethrough; and
- a lattice configured between the exterior segment and the acoustic device, the lattice comprising a plurality of unit cells, each unit cell defining an opening, wherein the plurality of unit cells are interconnected and define a plurality of openings, wherein the plurality of openings allow fluid to move between the interior of the surround and the exterior of the surround and enable the passage of the acoustic signals transmitted and/or received by the acoustic device such that the surround reduces the diminution of the quality and/or strength of the acoustic signals.

In one aspect, the lattice includes an acoustic channel, the acoustic channel defined by a portion of interconnected unit cells and the alignment of a portion of the plurality of openings of the portion of interconnected unit cells, and wherein the acoustic channel is in substantial alignment with the acoustic aperture such that the acoustic signals transmitted by and/or received by the acoustic device can travel within the acoustic channel and through the acoustic aperture in a manner that is substantially unimpeded by any part of the surround.

In one aspect, the at least one acoustic channel is a radially outward extending acoustic channel. In one aspect, the acoustic channel is configured to align with an acoustic element for transmitting and receiving the acoustic signals on the acoustic device. In one aspect, the acoustic element is an acoustic or ultrasonic transducer.

In one aspect, the lattice is resiliently deformable upon application and then removal of the force.

In one aspect, the lattice is configured to provide a varying distribution of resistance to compression that increases moving outwards from near the center to the outer periphery of the surround.

In one aspect, the varying distribution of resistance to compression comprises: a decrease in distance separating the plurality of interconnected unit cells; a decrease in dimension of the opening of each unit cell; or an increased thickness of each unit cell, moving outwards from near the center to near the outer periphery of the surround.

In one aspect, each unit cell is formed from a plurality of filaments, the filaments arranged to define the opening of each unit cell.

In one aspect, the filaments are elongate filaments

In one aspect, the plurality of interconnected unit cells comprise a stacked arrangement of unit cells, the stacked arrangement of unit cells being configured to permit adjacent unit cells to resiliently move in relation to each other.

In one aspect, the stacked arrangement of unit cells comprise a substantially overlapping zig-zag arrangement of each unit cell with an adjacent unit cell.

In one aspect, the plurality of interconnected unit cells comprise cubic edges, cubic diamonds, tetrahedron vertex centroids, or combinations thereof.

In one aspect, the surround further comprises one or more chambers for promoting the passage of acoustic signals, wherein the one or more chambers are devoid of the interconnected unit cells.

In one aspect, the surround further comprises one or more ports which penetrate into the one more chambers from the exterior.

In one aspect, the surround further comprises a band on the outer perimeter of the shell, the band configured to provide a continuous rolling surface for the surround.

In one aspect, the surround further comprises a retaining member positioned between the lattice and the acoustic device, the retaining member configured to secure the acoustic device within the surround.

In one aspect, the retaining member is a band configured substantially along the perimeter of an interior surface of the surround.

In one aspect, the shell and lattice is comprised of an elastomeric material.

In one aspect, the shell and lattice are comprised of the same elastomeric material.

In one aspect, the elastomeric material is polyurethane, synthetic rubber, or silicone, or combinations thereof.

In one aspect, the polyurethane is thermoplastic polyurethane.

In one aspect, the lattice is connected to the exterior segment at one or more exterior attachment points.

In one aspect, the shell further comprises an interior segment connected to the exterior segment and adjacent the acoustic device, and wherein the lattice is connected to the interior and exterior segments at one or more interior attachment points.

In one aspect, the surround is formed by the reversible coupling of at least two complementary portions, each one of the portions comprising attachment means configured to couple the complementary portions.

In one aspect, the attachment means is a screw and threaded insert, sewing, friction coupling, bonding, or combinations thereof.

In one aspect, the exterior segment comprises a plurality of interconnected beams.

In one aspect, the at least one acoustic aperture is defined by a group of the plurality of interconnected beams.

In one aspect, the plurality of interconnected beams are arranged as a tessellation of triangles.

In one aspect, the exterior segment is substantially spherical or is an ellipsoid.

In one aspect, the exterior segment is substantially an oblate or prolate spheroid.

According to an embodiment, the present disclosure relates to a surround for protecting a pipeline inspection device securable therein from impact, the surround comprising:

a shell configured to rollably engage the interior surface of the pipeline, the shell comprising an exterior segment configured to resiliently resist a force from an impact; and a webbed arrangement of filaments supported by the exterior segment and configured between exterior segment and the acoustic device, and wherein during impact with a force sufficient to deform the shell, the force causes a portion of the webbed arrangement of filaments in a resting position to compress into a loaded position, the movement attenuates the force by redirecting a portion of the force away from the acoustic device, and wherein after the impact and the removal of the force, the portion of webbed arrangement of filaments expand back into the resting position.

In one aspect, the webbed arrangement of filaments is configured to provide a varying distribution of resistance to compression that increases moving outwards from near the center to the outer periphery of the surround In one aspect, the varying distribution of resistance to compression comprises: a decrease in distance separating filaments of the webbed arrangement of filaments or an increased thickness of filaments of the webbed arrangement of filaments, moving outwards from near the center to near the outer periphery of the surround.

In one aspect, the webbed arrangement of filaments comprises a plurality of internal flexures, wherein the movement into the loaded position will increase the degree of arc of the internal flexures in the portion of webbed arrangement of filaments.

In one aspect, the webbed arrangement of filaments is supported by the exterior segment by connection to the exterior segment at one or more exterior attachment points.

In one aspect, the shell further comprises an interior segment connected to the exterior segment and adjacent the acoustic device, and wherein the webbed arrangement of filaments is supported by the interior segment by connection to the interior segment at one or more interior attachment points.

DETAILED DESCRIPTION

Figure 1:
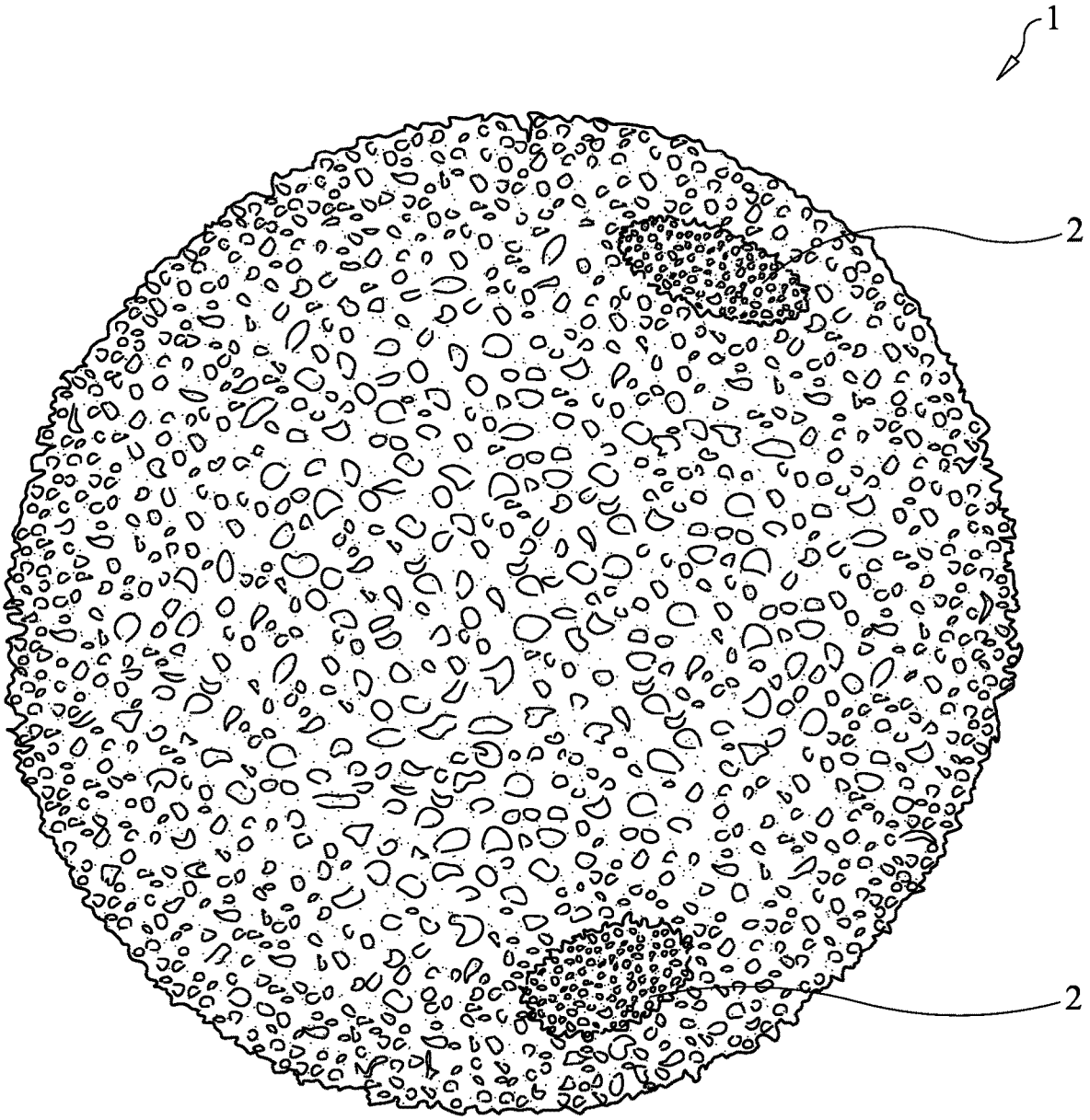
Prior art FIG. 1
FIG. 1 is a perspective view of a foam surround known in the prior art.

Reference will be made below in detail to exemplary embodiments of the invention, examples of which are illustrated in the accompanying drawings. Wherever possible, the same reference numerals used throughout the drawings refer to the same or like parts.

With reference to the FIGS. 1 to 14, surround 10 is configured to receive and protect a pipeline inspection device 12 inside the surround 10 from impact. In an example embodiment, the pipeline inspection device 12 may be an acoustic device 12. Acoustic device 12 can comprise one or more acoustic elements 14 configured to transmit and/or receive acoustic signals. In one embodiment, one or more acoustic elements 14 which may be placed at various locations at or in close proximity to the outer periphery of acoustic device 12 for maximizing the transmission of and/or the reception of acoustic signals from the pipeline.

Broadly, surround 10 comprises a shell 20 configured to roll along the interior surface of the pipeline (not shown) and a liner 40 configured between the shell 20 and the acoustic device 12, the liner 40 defining an interior volume 42 dimensioned for receiving the acoustic device 12.

The shell 20 can include an exterior segment 22 configured to resiliently resist a force from an impact to the outside of the surround 10. The exterior segment 22 approximates a shape that enables the surround 10 to roll along the interior surface of the pipeline.

The exterior segment 22 comprises a plurality of beams 24 and a plurality of attachment points 26 for the liner 40. The beams 24 are configured with a certain amount of rigidity such that when the applied force is relatively small and below a certain threshold, the beams 24 are able to resist deformation and maintain the shape of the shell 20. The plurality of beams 24 are configured to deform when the applied force exceeds the certain threshold. Whereupon the removal of the applied force, the plurality of beams 24 are configured to return back to their form prior to deformation.

The plurality of beams 24 can be arranged to define at least one acoustic aperture 28, the purpose of which will be described in greater detail below. The arrangement of the plurality of beams 24 around the at least one acoustic aperture 28 can take the form of any regular geometric shape, irregular geometric shape, or a combination of regular and irregular geometric shapes.

In an example embodiment, the exterior segment 22 approximates the shape of a sphere which enables rolling along the interior surface of the pipeline. In a preferred embodiment, the exterior segment 22 comprises a plurality of beams 24, wherein three (3) beams 24 are arranged to form a triangle shape around the acoustic aperture 28. The plurality of individual triangles are interconnected and arranged as a tessellation of triangles such contoured so that the exterior segment 22 approximates the spherical shape. The geometry of the tessellation of triangles may be one preferred embodiment because this geometric arrangement may provide a large number of attachment points 26 (i.e. nodes) for the liner 40 as will be described in greater detail below.

As described above, the exterior segment 22 can assume a substantially spherical shape according to one example embodiment. However, the exterior segment 22 can be of any shape which would enable the surround 10 to roll along the interior surface of the pipeline.

For example, in broad terms, the exterior segment 22 can be an ellipsoid including three perpendicular axes of symmetry which intersect at a center of symmetry. Among ellipsoid shapes, the exterior segment 22 can be spheroid where two of the axes of symmetry have an equal length. In some example embodiments, the spheroid is an oblate spheroid (e.g. curling rock or the earth) where the third axis is shorter than the other two axes. In other example embodiments, the spheroid is a prolate (elongated) spheroid (e.g. an American football, rugby ball, watermelon, or some blimps) where the third axis is longer than the other two axes.

In the example embodiments where the shape of the exterior segment 22 is not substantially spherical, such as for example, either an oblate or prolate spheroid, surround 10 can be configured to have a specific center of mass in order to force the rotation about one preselected axis (e.g. the third axis) in such a manner that an equatorial surface defined by the other two axes is what rollably engages the interior surface the pipeline. Furthermore, in these embodiments, shape of the exterior segment 22 can be configured so that the shape modulates the velocity of the travel within the pipeline. According to some embodiments, exterior segments 22 having a substantially oblate or prolate spheroid shape may be particularly useful in situations where there is a need to increase drag and therefore limit the speed of travel of surround 10 within the pipeline.

In some embodiments, the shell 20 can also include an interior segment 30 which is connected to the exterior segment 22. When provided, the interior segment 30 can be adjacent the acoustic device 12, and the liner 40 can be between the exterior and interior segments 22, 30. Interior segment 30 may also include a plurality of attachment points 26 for liner 40.

Liner 40 can be configured between the exterior segment 22 and the acoustic device 12 and comprises a three-dimensional lattice 44 including a plurality of openings 50. While the specific features and the purpose of the plurality of openings 50 and the structures which make up the lattice 44 will be described in greater detail below, it will be understood that the plurality of openings 50 and lattice 44 are configured in a manner that may generally permit free-flow of fluid (gas or liquid) from one region to another region of lattice 44 by moving through the plurality of openings 50. In other words, the plurality of openings 50 form a plurality of pores or interstices which contribute to a continuously open structure of lattice 44 and this continuously open structure contributes to an acoustic transparency whereby acoustic signals travelling as between acoustic device 12 located in the interior of surround 10 and the exterior of surround 10 are able to move in a manner that is relatively unimpeded (or only minimally impeded) by any portion of liner 40 or lattice 44 or any portion of surround 10, for that matter. Relatively unimpeded is understood to mean that the structures of lattice 44 do not act as a significant barrier to the movement the acoustic signals and the quality and/or strength of the acoustic signals either transmitted and/or received by acoustic device 12 is not significantly diminished by the passage of these acoustic signals moving in any outward direction or moving in any inward direction, as the case may be, through surround 10. In this embodiment, the surround 10 is configured to reduce the diminution of the quality and strength of the acoustic signals as they pass through the surround 10.

At a periphery of liner 40, and therefore, at a terminus of the lattice 44, the lattice 44 may be connected to the exterior segment 22 at a plurality of attachment points 26 distributed around the exterior segment 22 of surround 10. At an opposing periphery of liner 40, and therefore, at the other terminus of the lattice 44, the lattice 44 may be connected to the interior segment 30 at one or more attachment points 26. In other words, lattice 44 is configured in a webbed-like arrangement that is bounded by the exterior segment 22 and interior segment 30 of the shell 20, according to one embodiment.

Figure 10:
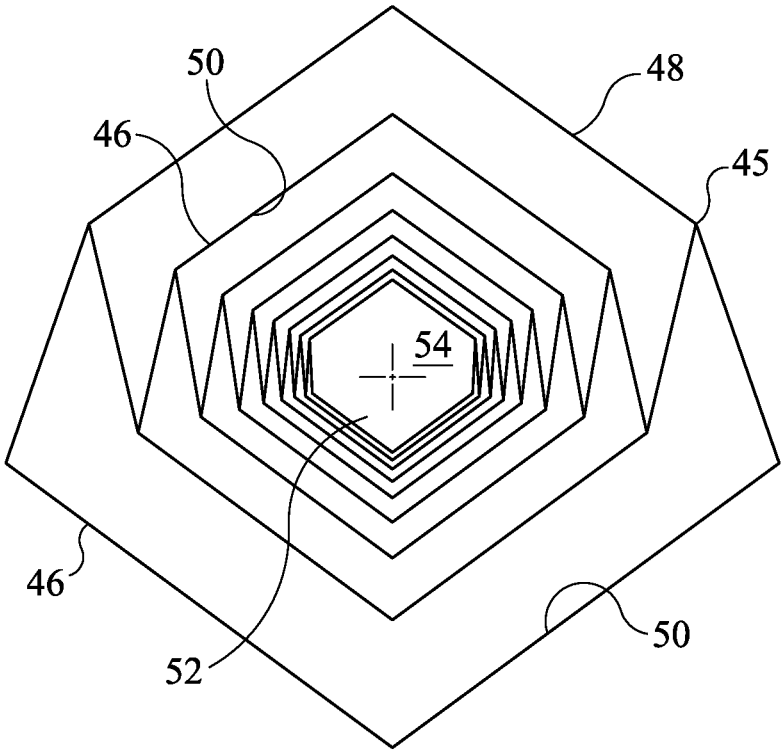
FIG. 10 is a top view looking down into the one radially outward extending acoustic channel of FIG. 9.
Figure 11:
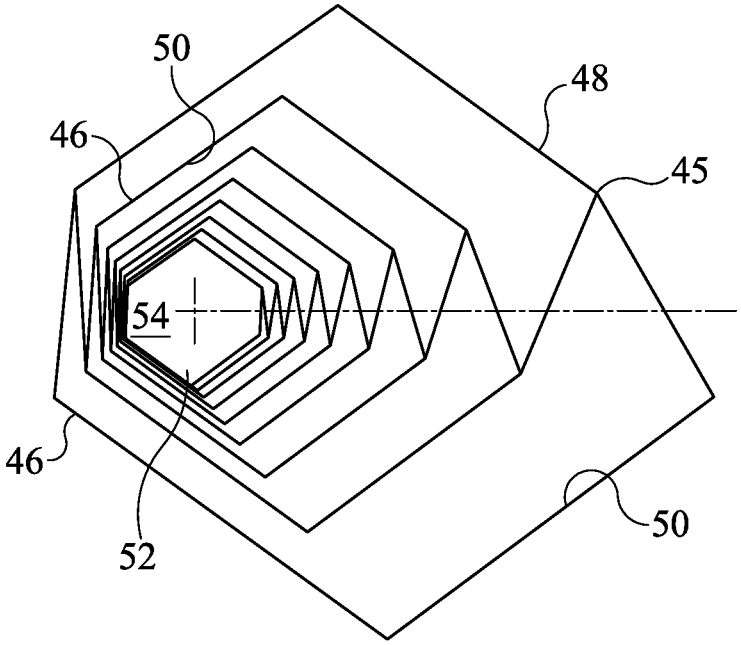
FIG. 11 is a perspective view looking down into the acoustic channel of FIG. 10.

With reference to FIGS. 10 to 12, according to an embodiment, the lattice 44 can be formed from a plurality of interconnected unit cells 46. Each unit cell 46 comprises an assembly of filaments 48 and the filaments 48 are arranged into a geometric shape to define opening 50. Therefore, each unit cell 46 can be considered to be a substantially hollow unit cell 46 because each unit cell 46 will form a geometric shape having at least one opening 50. Filaments 48 may include one or more properties including: an elongate shape, compressibility, and resiliency.

According to an embodiment, at least a portion of the plurality of interconnected unit cells 46 can be arranged to form an acoustic channel 52. Acoustic channel 52 forms a passage 54 for the substantially unimpeded bidirectional movement of acoustic signals moving through the surround 10 (i.e. moving to/from the acoustic device 12 to outside of the surround 10 and into the pipeline). In one example embodiment, acoustic channel 52 comprises a plurality of unit cells 46 in a stacked arrangement of unit cells 46. For each particular acoustic channel 52, each unit cell 46 in the stacked arrangement of unit cells 46, is arranged so that the opening 50 of each unit cell 46 is in substantial alignment with the opening 50 of an interconnected adjacent unit cell 46 of that particular acoustic channel 52. Therefore, it is the substantial alignment of the plurality of openings 50 from least a portion of the plurality of interconnected unit cells 46 which define the acoustic channel 52.

In this one embodiment, the acoustic signals travel through the opening 50 of each unit cell 46 forming part of the acoustic channel 52 and do not substantially encounter the filaments 48 of the unit cells 46 that make up the particular acoustic channel 52. Moreover, the acoustic signals that are made to travel within acoustic channel 52 neither substantially encounter filaments 48 of any neighboring unit cells 46 that do not form part of the particular acoustic channel 52 nor substantially encounter any other part of shell 20 or surround 10. The acoustic channel 52 can be configured so that it is in substantial alignment with the acoustic aperture 28 and therefore, the acoustic signals that may travel within the acoustic channel 52 will also avoid substantially encountering any part of the shell 20 or only minimally encountering any part of the shell 20 or any other portion of surround 10. In this aspect, acoustic channel 52 channels the acoustic signals through surround 10 because the quality and/or strength of the acoustic signals are not significantly affected by any of the various structures that make up liner 40 and/or shell 20.

In some other embodiments, one or more acoustic channels 52 can be configured to extend radially outwards from about the center of surround 10 to the periphery of surround 10. In this embodiment, the center of the radially outward extending acoustic channel 52 may intersect the center of the surround 10. The one or more radially outward extending acoustic channels 52 can be configured so that each one is in substantial alignment with one or more acoustic apertures 28 of the shell 20 and the acoustic element 14 of the acoustic device 12, and therefore, the acoustic signals that may travel within the acoustic channel 52 will avoid substantially encountering any part of the shell 20 or only minimally encountering any part of the shell 20 or surround 10. In this manner, the acoustic device 12 may be permitted to maximize transmission and/or the collection of acoustic signals useful for detecting anomalies in the pipeline, for example.

The combination of acoustic channel 52 and acoustic aperture 28 and the specific alignment and arrangement thereof contributes to an increased acoustic transparency to surround 10. This acoustic transparency may be particularly beneficial when there is a need to generate very high frequencies using the acoustic device 12 and then transmit these very high frequencies outwards and towards the fluid contained in the pipeline.

As described above, acoustic signals travel through surround 10 by moving through the plurality of openings 50 of lattice 44. In some embodiments, each one opening 50 is defined by one unit cell 46. As will be described in further detail below, lattice 44 and unit cell 46 are supporting structures and therefore, in use when surround 10 may be compressed, the lattice 44 and unit cell 46 are able to resist any significant deformation that would significantly increase the closing of the one or more openings 50 and/or acoustic channel 52 for the movement of the acoustic signals.

Moreover, in use, surround 10 may also roll into a less than ideal position whereby a portion of pipeline itself may temporarily occlude one or more of the acoustic channels 52, however, in the case of the present disclosure, such a restriction may not or may only minimally affect the overall propagation of the acoustic signals because of the increased acoustic transparency provided by the components of surround 10.

The present invention is in contrast to prior art foam surrounds whereby movement of the acoustic signals depends predominantly on the movement through the ports 2 and if one or more of the ports 2 are restricted by compression and/or physical occlusion, the movement of the acoustic signals can be detrimentally affected.

Figure 6:
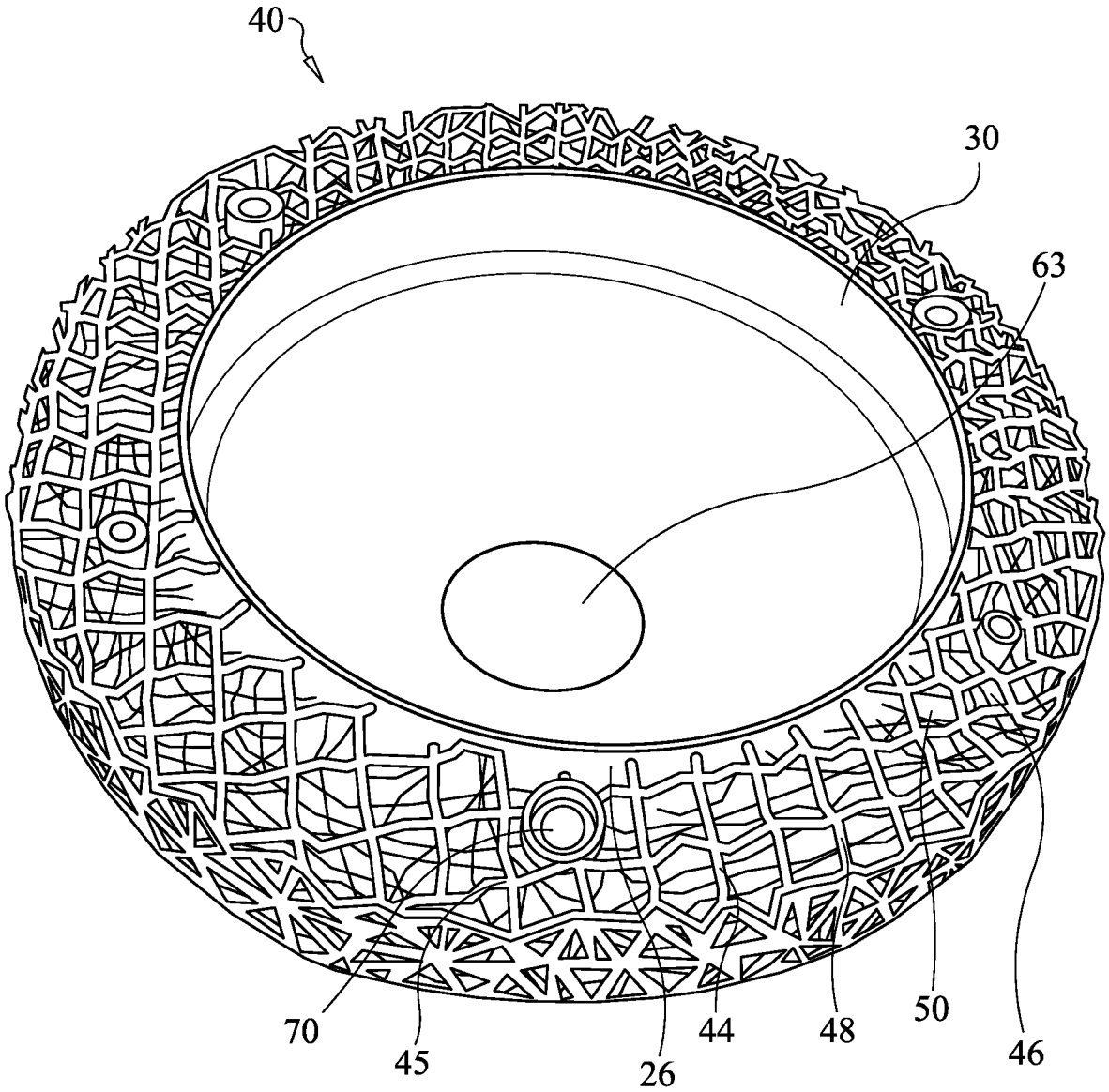
FIG. 6 is a perspective sectional view of the liner comprising the lattice including a plurality of openings shown in isolation from the shell.
Figure 7:
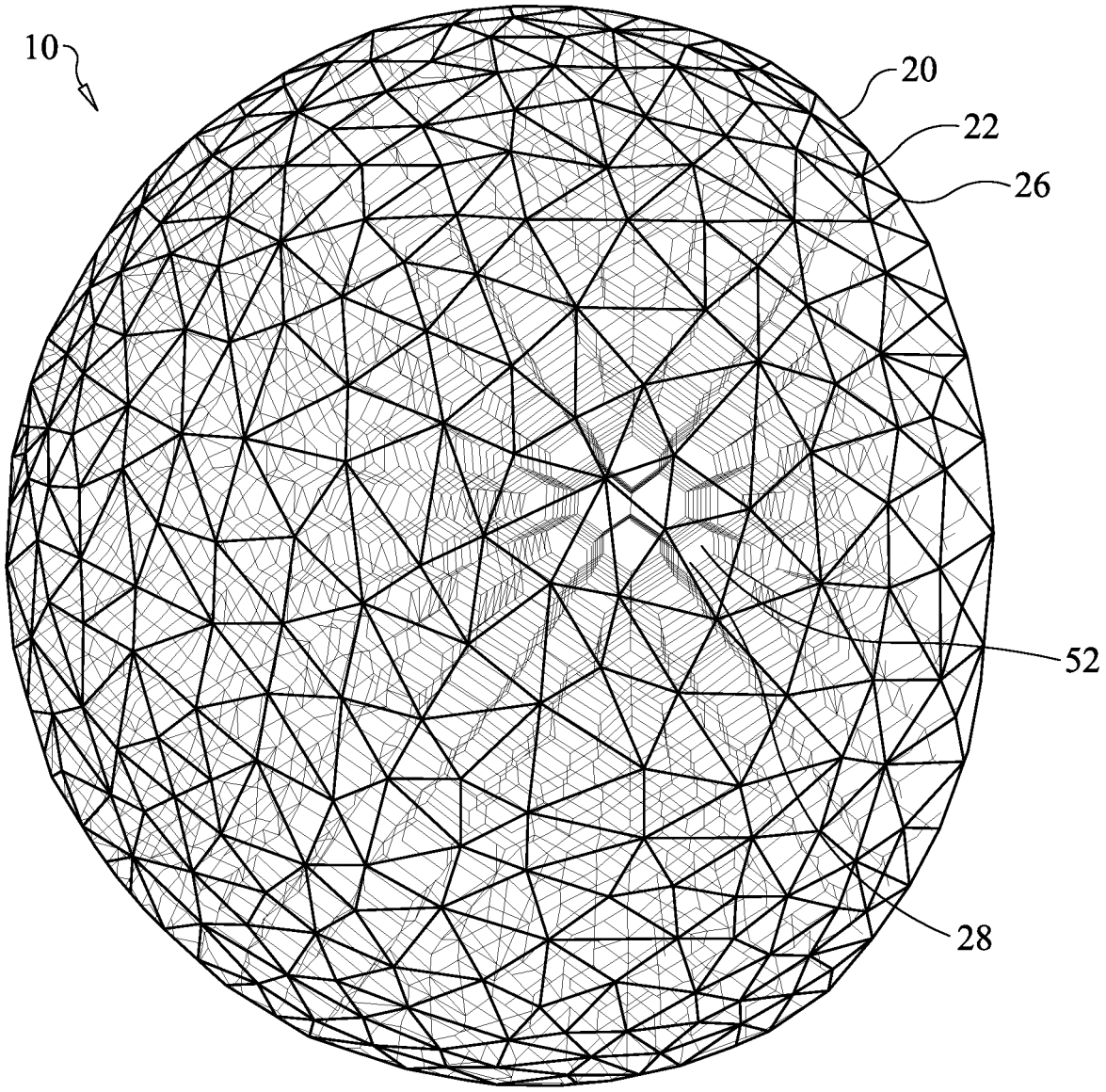
FIG. 7 is a perspective view of the surround showing the shell having a plurality of acoustic apertures and wherein a plurality of openings align to form at least one acoustic channel, in accordance with an embodiment of the invention.
Figure 8:
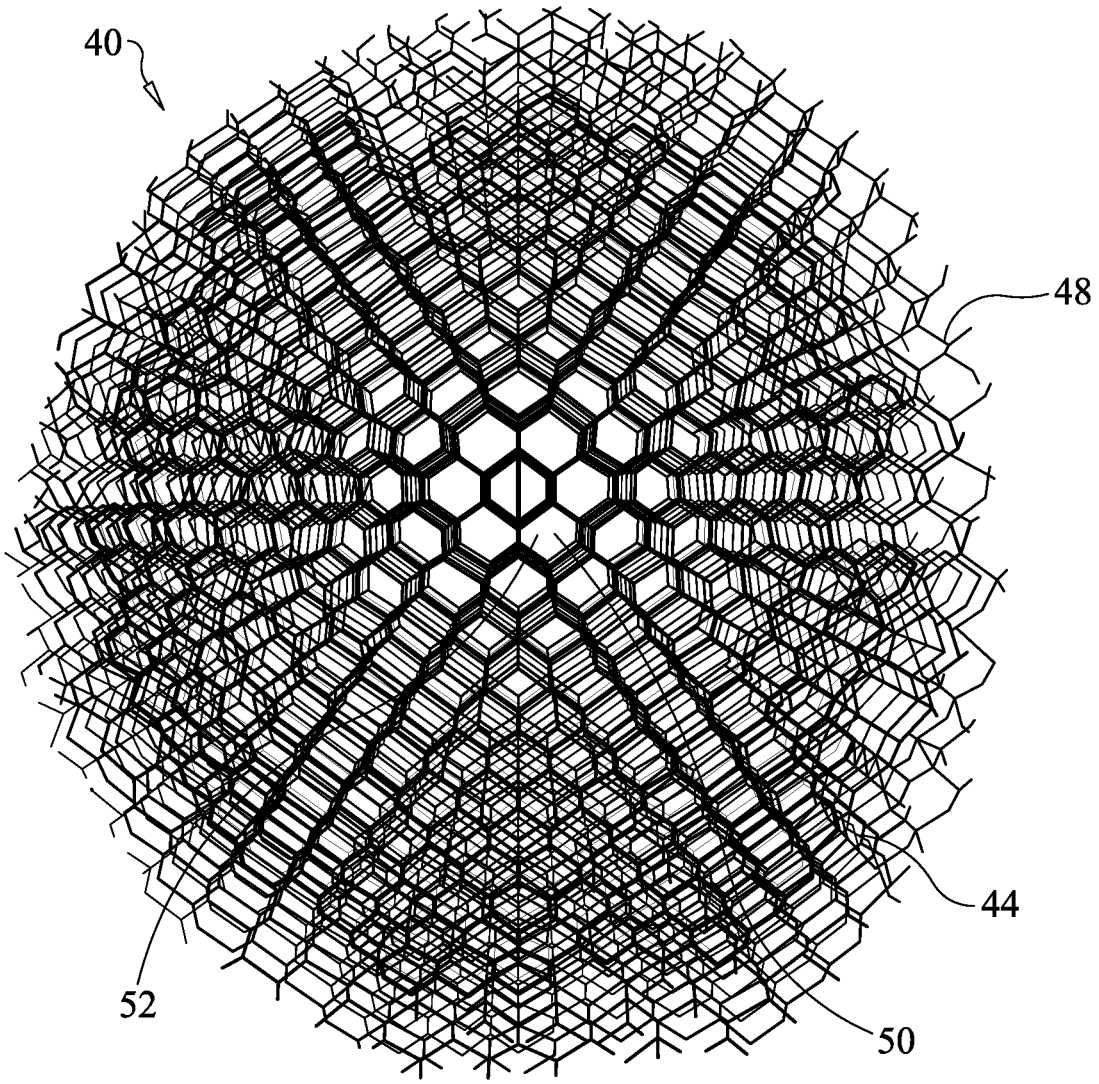
FIG. 8 is a perspective view of the surround of FIG. 7 showing a plurality of acoustic channels in isolation from the shell having a plurality of acoustic apertures.
Figure 9:
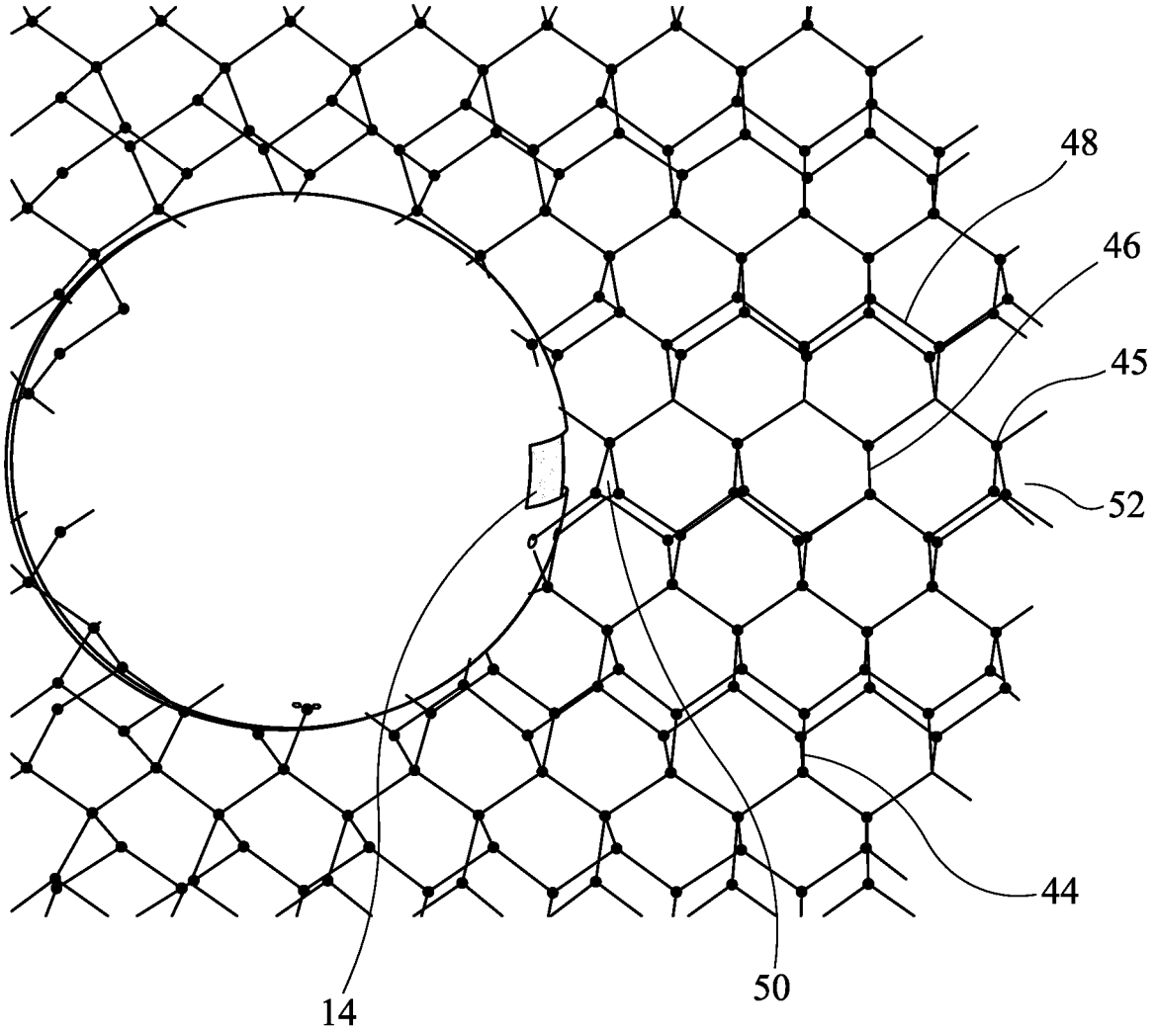
FIG. 9 is a perspective view of a schematic representation of a portion of the surround including a shell, an acoustic device, and a liner comprising a stacked arrangement of cubic diamond unit cells.

As shown in the embodiments of FIG. 6, the lattice can comprise a plurality of tetrahedron vertex centroids unit cells 46. As shown in the embodiment of FIGS. 7 to 12, the lattice 44 can comprise a plurality of cubic diamond unit cells 46. In other embodiments, the lattice 44 can comprise the cubic edge unit cells 46. The lattice 44 may comprise a plurality of unit cells 46 having an identical geometry or may include a plurality of unit cells 46 having a variety of different types of geometries. The geometries of the unit cells 46 are selected to increase surface area exposure of the device 12 to the fluid contained in the pipeline.

Figure 12A:
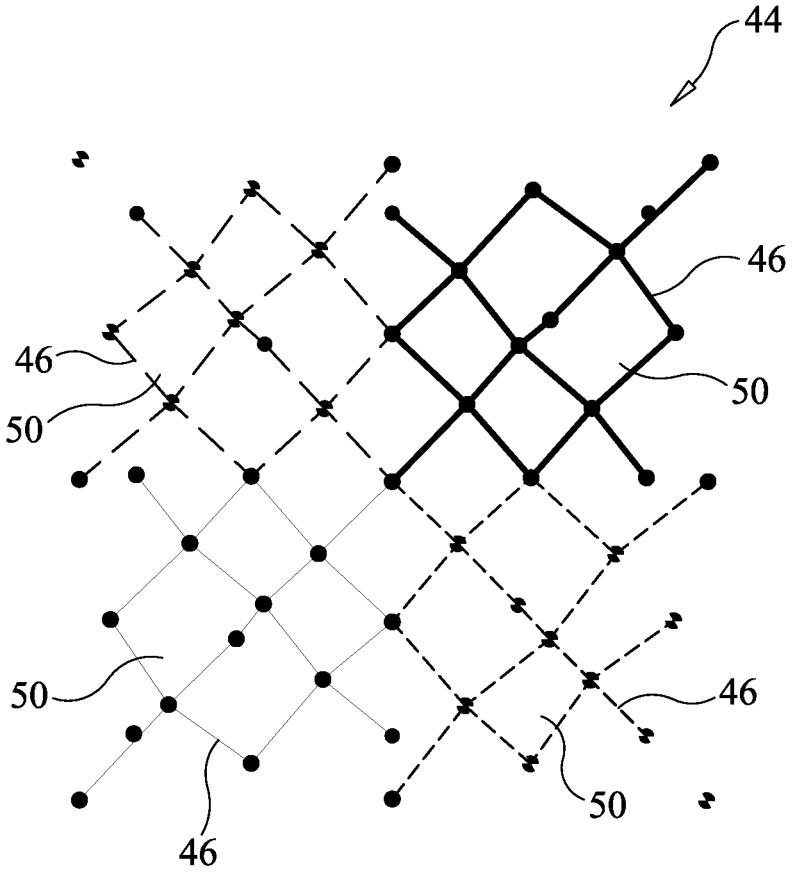
FIG. 12*a* is an enlarged top view showing an arrangement of four cubic diamond unit cells.
Figure 12B:
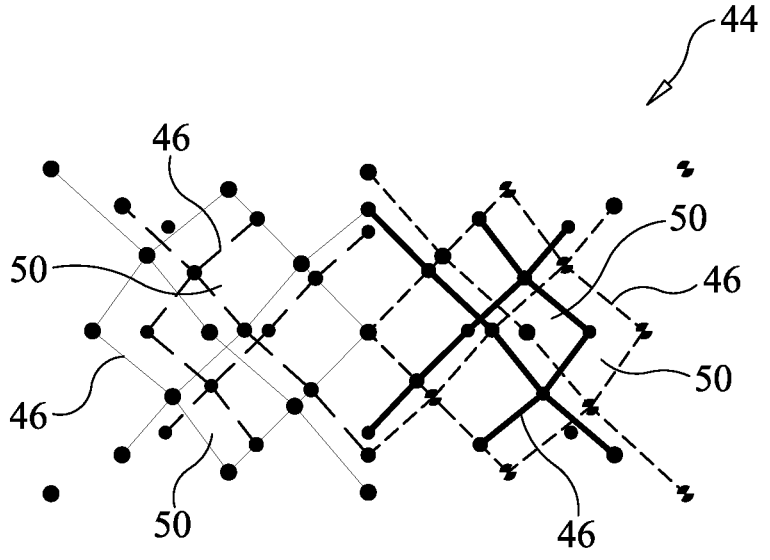
FIG. 12*b* is a front view of the unit cells of FIG. 12*a;*
Figure 12C:
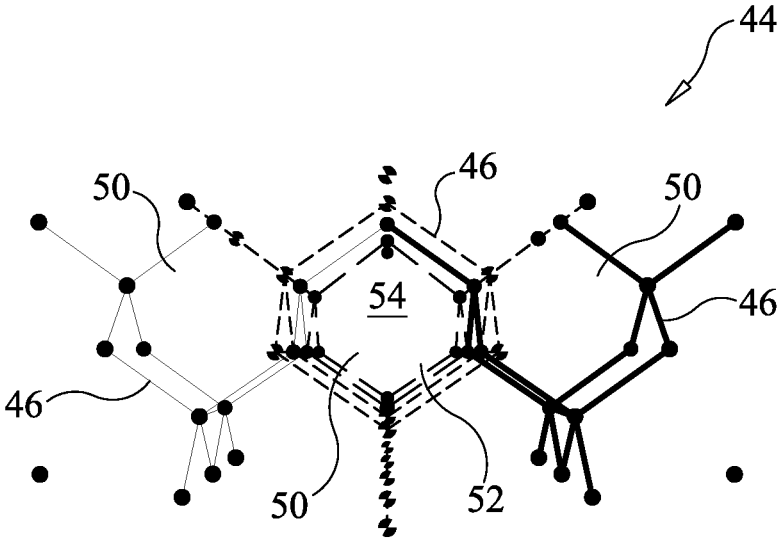
FIG. 12*c* is a front and side view of the unit cells of FIG. 12*a* showing the acoustic channel.
Figure 12D:
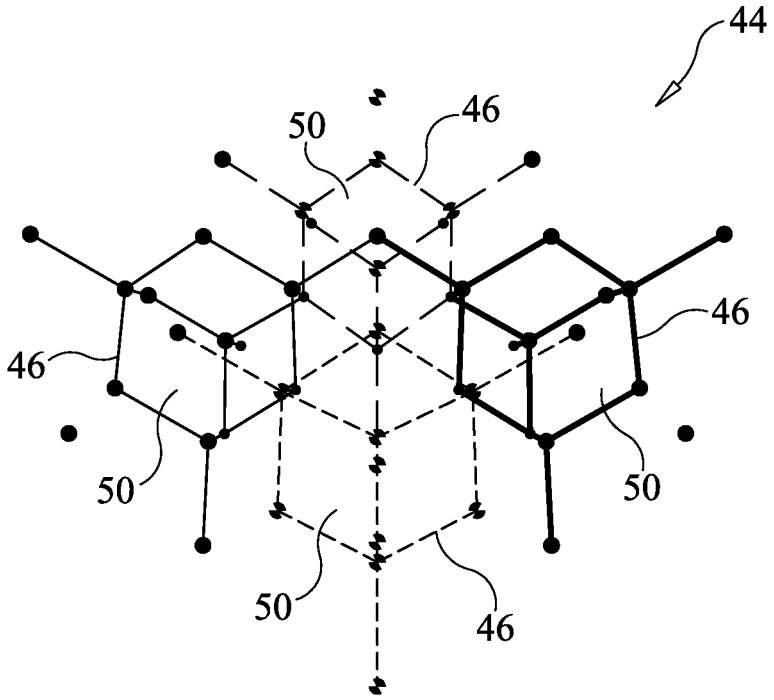
FIG. 12*d* is a top and front view of the unit cells of FIG. 12*a;*

FIGS. 12*a* to 12*d* show enlarged views of an arrangement of four cubic diamond unit cells 46 of a section of lattice 44. FIG. 12*a* is an enlarged top view of four cubic diamond unit cells 46 where each unit cell 46 defines at least one opening 50. FIG. 12*b* is a front view of the four cubic diamond unit cells 46 of FIG. 12*a* showing two of the four unit cells 46 in front with other two unit cells 46 directly behind. FIG. 12*c* is a front and side view of the four cubic diamond unit cells 46 of FIG. 12*a*. This view shows acoustic channel 52 formed from an alignment of openings 50 of two of the four unit cells 46. It can been seen that although lattice 44 is configured such that acoustic signals can travel and would only be minimally impeded in any direction through this section, any acoustic signals made to travel within passage 54 will substantially avoid encountering filaments 48 of any neighboring unit cells 46 that do not form part of acoustic channel 52.

Figure 13:
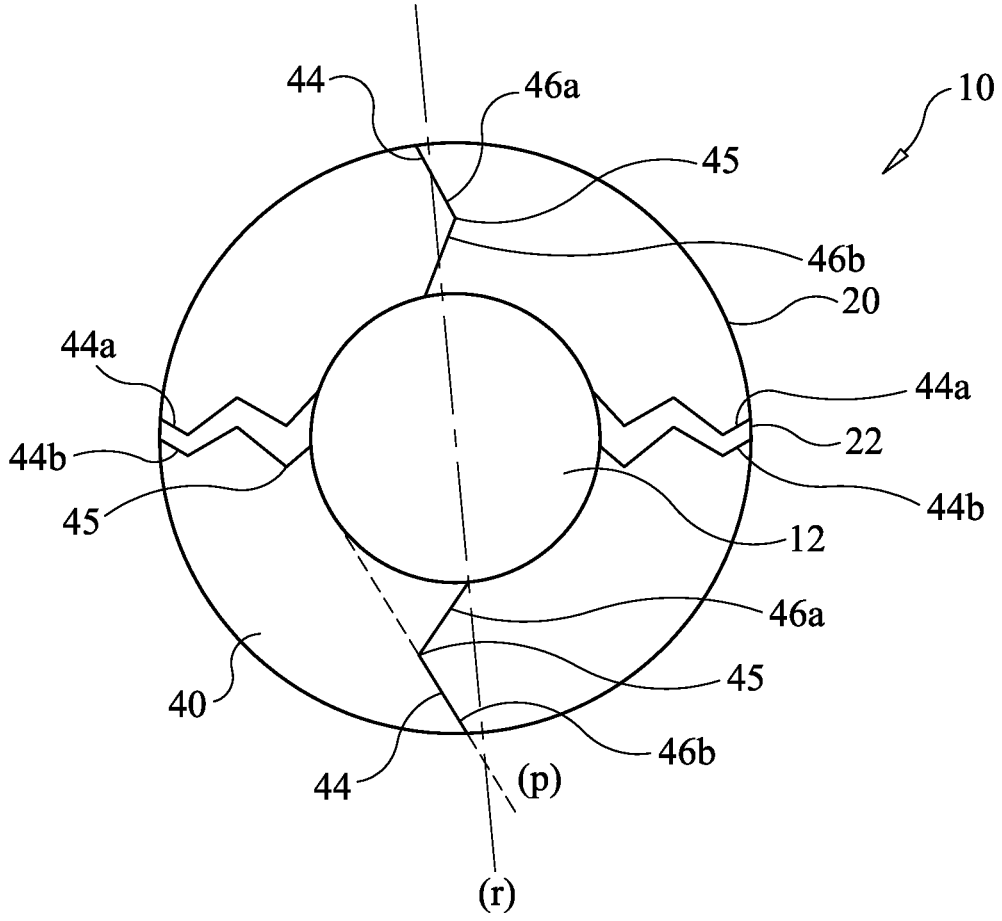
FIG. 13 is a schematic representation of a surround including a shell, an acoustic device, and a liner including a lattice comprising unit cells, in accordance with an embodiment of the invention where the unit cells are in a resting position.
Figure 14:
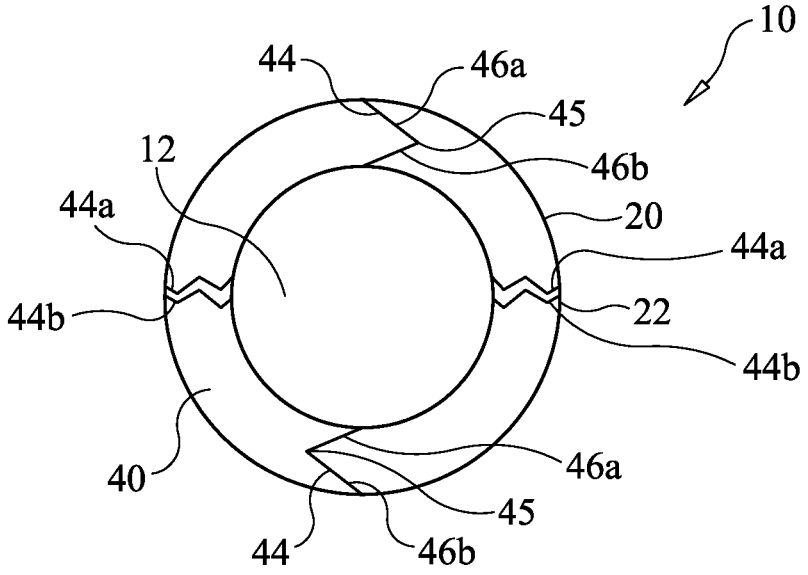
FIG. 14 is a schematic representation of the surround of FIG. 13 during the application of force to compress the unit cells of the lattice into a loaded position.

Liner 40 can be configured to resiliently resist forces transmitted from the exterior segment 22 and directed into the center of the surround 10 and the acoustic device 12 securable therein. FIGS. 13 and 14, show a simplified surround 10 comprising shell 20 with an exterior segment 22, acoustic device 12, and liner 40 therebetween. Solely for the purposes of explanation, the liner 40 comprises a simplified lattice 44. According to an example embodiment, lattice 44 comprises two sets of unit cells 46: a first unit cell 46*a* and a second unit cell 46*b*. At the junction between the first and second unit cells 46*a* and 46*b* is a bend 45. In this example, bend 45 is an acute angle, however, bend 45 may form a smooth gradual arc or may be any angle less than 180 degrees. As configured, lattice 44 will have a certain amount of internal flexure (or arc) and as will be discussed in greater detail below, in certain example embodiments, the provision of one or more internal flexures (or arcs) between the termination points of lattice 44 (i.e. the points of connection 26 to the exterior segment 22 and the interior portion of lattice 44 adjacent to the center of surround 10) allows the liner 40 attenuate the forces directed into the center of surround 10.

Shown in FIG. 13 is surround 10 where surround 10 is not subjected to any external forces (e.g. compressive forces due to impact with an exterior object, for example). In this state, the lattice 44 is said to be in its resting position.

As shown in FIG. 14, when an application of a force (e.g. due to impact) is sufficiently large enough that it can compressively deform the shell 20 and the exterior segment 22, the force will cause at least a portion of the lattice 44 to compress into a loaded position. In this case, the force will cause the lattice 44 to bend close to (or at) the region of bend 45. The consequence of the bending will bring unit cells 46*a* and 46*b* into closer proximity. In being able to assume the loaded position, the lattice 44 (and thus, liner 40 of the present disclosure) decrease the amount of force transmitted directly towards the acoustic device 12 because at least a portion of the force is attenuated by liner 40 when the lattice 44 is bent and at least a portion of the force is directed away from the acoustic device 12.

The lattice 44 according to the present disclosure is in contradistinction to a situation where a liner comprising an arrangement of unit cells or filaments that are linear and extend radially from a point (a) around the center of the surround 10 directly to a point (b) around the periphery of the surround 10 and have a length (l). Such linearly arranged radially extending filaments are linear (do not have any internal bends) so do not have any flexure (or arc) and may resemble the spokes on a wagon wheel. Such spokes would tend to transmit a greater portion of the forces directly into the center of surround 10 and the acoustic device 12 securable therein. In keeping with analogy described above, in the liner 40 according to the present disclosure, lattice 44 comprises a plurality of unit cells 46 or filaments 48 that extend radially from point (a) to point (b) but would have a length (L), where L>l. In such an embodiment, the increase in length provides the desired flexure (arc) in the liner 40/lattice 44/unit cells 46 sufficient to attenuate forces directed to the center of the surround 10.

The specific relationship of the structures of liner 40 which allow it to resiliently resist forces transmitted from the exterior segment 22 and directed into the center of the surround 10 and the acoustic device 12 securable therein can also be described with additional reference to FIG. 13. As shown in FIG. 13, the interconnected unit cells 46 connecting the exterior segment 22 to the interior of surround 10 are arranged so that a portion of the interconnected unit cells 46 will lie within a plane (p) that intersects a radial plane (r) that passes through the center of the surround 10 and which also bisects the circumference of the exterior segment 22.

The lattice 44 according to the present disclosure may have addition advantages, among which include, a more uniform rolling action because it avoids situations where the surround 10 may have an anisotropic stiffness. Anisotropic stiffness should be avoided because this may generate acoustic noise that might interfere with the detection equipment.

When the application of deforming force is removed, the lattice 44 decompresses and the structure of lattice 44 returns to its resting position as show in FIG. 13.

As shown in FIGS. 6 to 12, the lattice 44 according to the present disclosure comprise radially outward extending stacked arrangement of unit cells 46. With particular reference to FIGS. 7 to 12, it can be seen that the unit cells 46, in this case, cubic diamond unit cells 46, are arranged in a substantially overlapping zig-zag arrangement of each unit cell with an adjacent unit cell 46. The substantially overlapping zig-zag arrangement approximately resembles the type of folds or bends as seen in an accordion, for example. Wherein under force, the substantially overlapping zig-zag arrangement will allow a unit cell 46 to compress or flex/bend depending on the location of the impact, in relation to adjacent unit cells 46 whereby the overall net effect may be a movement of the radially outward extending stacked arrangement of unit cells 46 into the loaded position. Similarly, when the force is removed, the radially outward extending stacked arrangement of unit cells 46 will resiliently return to their resting position, prior to impact.

In the example embodiments shown FIGS. 7 to 14, lattice 44 comprise one or more bends 45 which, for example, may be defined at the junction between adjacent unit cells 46. However, the bends 45 may be formed at other regions within the lattice 44. For example, in other embodiments, lattice 44 may comprise one or more unit cells 46 where bend 45 is formed at a point between the ends of the filaments 48 making up the unit cell 46. In response to a force sufficient to compress the exterior segment 22, the force can cause at least some of the filaments 48 to further compress (i.e. flex) and absorb at least some of the energy of the impact. Upon removal of the force, the filaments 48 expand back into the resting position, prior to impact.

With reference to FIGS. 13 and 14, according to an example embodiment, the surround 10 may be configured to have a varying distribution of resistance to compression in order to optimize the compressibility of the surround 10 for application whereby the diameter of the entry port into the pipeline is comparatively smaller than the diameter of the surround 10. In this respect, the varying distribution of resistance to compression allows the manufacture of a slightly larger diameter surround 10 (i.e. where increased attenuation of force is needed) for any given application because the surround can be configured to enable significant compression with only minimal amount of effort. This is a contradistinction to the foam ball surround of the prior art which may be difficult to compress or require significant force to compress further once a certain compression limit is reached.

For example, the surround 10 may be configured to have a resistance to compression that increases moving outwards from the center of the surround 10 to the outer periphery of the surround 10.

In one embodiment, the varying distribution of resistance to compression can be achieved by liner 40 comprising a larger distance separating the plurality of interconnected unit cells 46 of lattice 44*a* and lattice 46*b* near the center of the surround 10 and wherein a relatively higher resistance to compression is provided by a relatively smaller distance separating the plurality of interconnected unit cells 46 near the outer periphery of the surround 10.

In another embodiment, the varying distribution of resistance to compression can be achieved by liner 40 comprising interconnected unit cells 46 that decrease in dimension moving outward from near the center to near the periphery of the surround. In aspects, the interconnected unit cells 46 can include a comparatively smaller dimensioned opening 50 moving outward from near the center to near the periphery of the surround.

In another embodiment, the varying distribution of resistance to compression can be achieved by liner 40 comprising interconnected unit cells 46 with increased filament 48 thickness moving outward from near the center to near the periphery of the surround.

The effect of these configurations will be that the unit cells 46 near the periphery of the surround 10 will more resistant to deformation and will provide sufficient structural integrity to maintain the shape of the surround 10, whereas the unit cells 46 near the center of the surround 10 will have less resistance to deformation and can be configured with only as much structural integrity to provide an appropriate cushioning to acoustic device 12. Since the surround 10 can be configured with the varying distribution of resistance to compression, in use, this may reduce the amount of compressive forces required to insert the surround 10 into the pipeline as compared to a similarly dimensioned foam ball surround.

Figure 2:
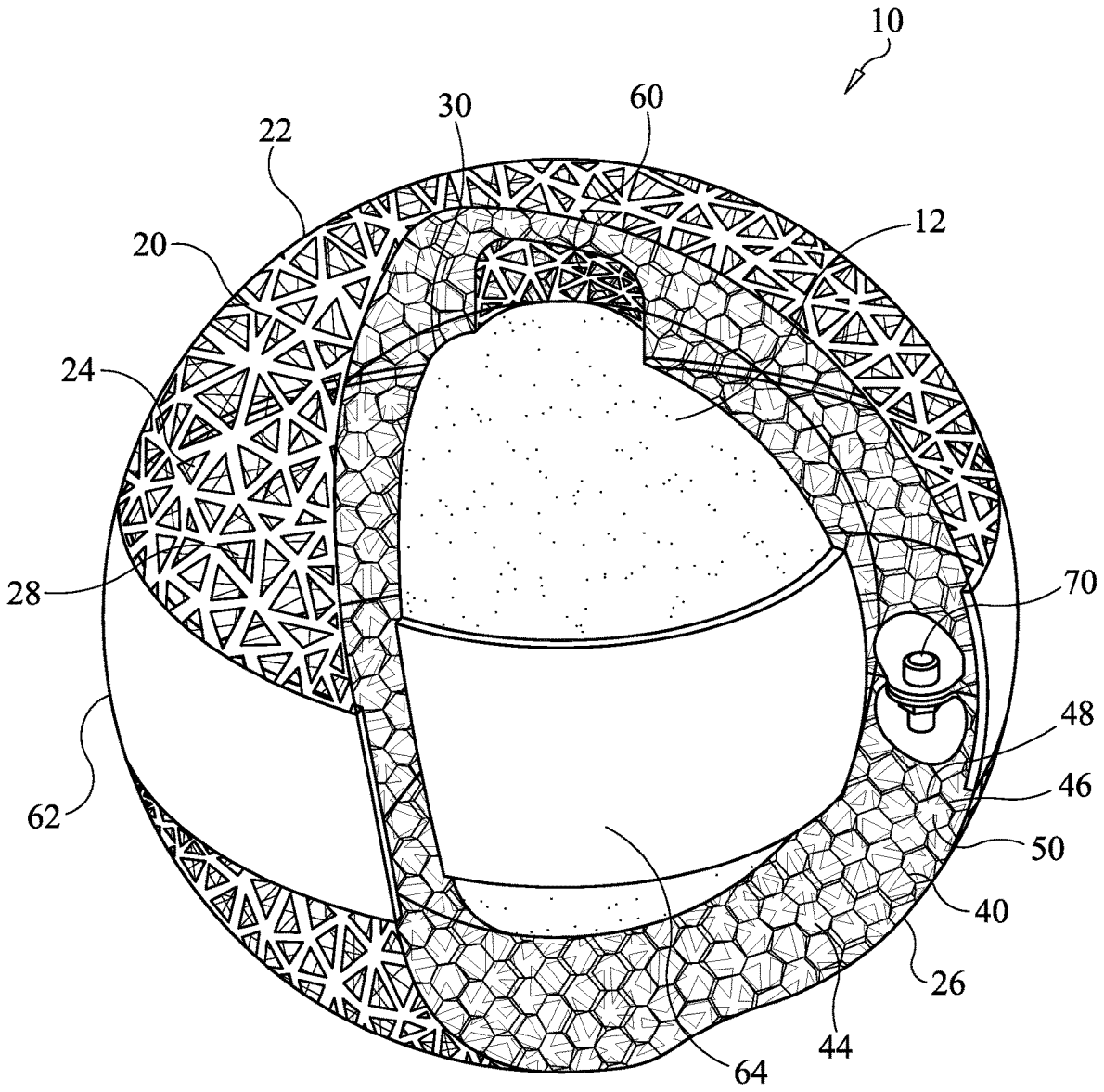
FIG. 2 is a perspective cutaway view of a surround for protecting a pipeline inspective device revealing the external and internal structure of the surround and a pipeline inspective device contained therein, in accordance with an embodiment of the invention.
Figure 4:
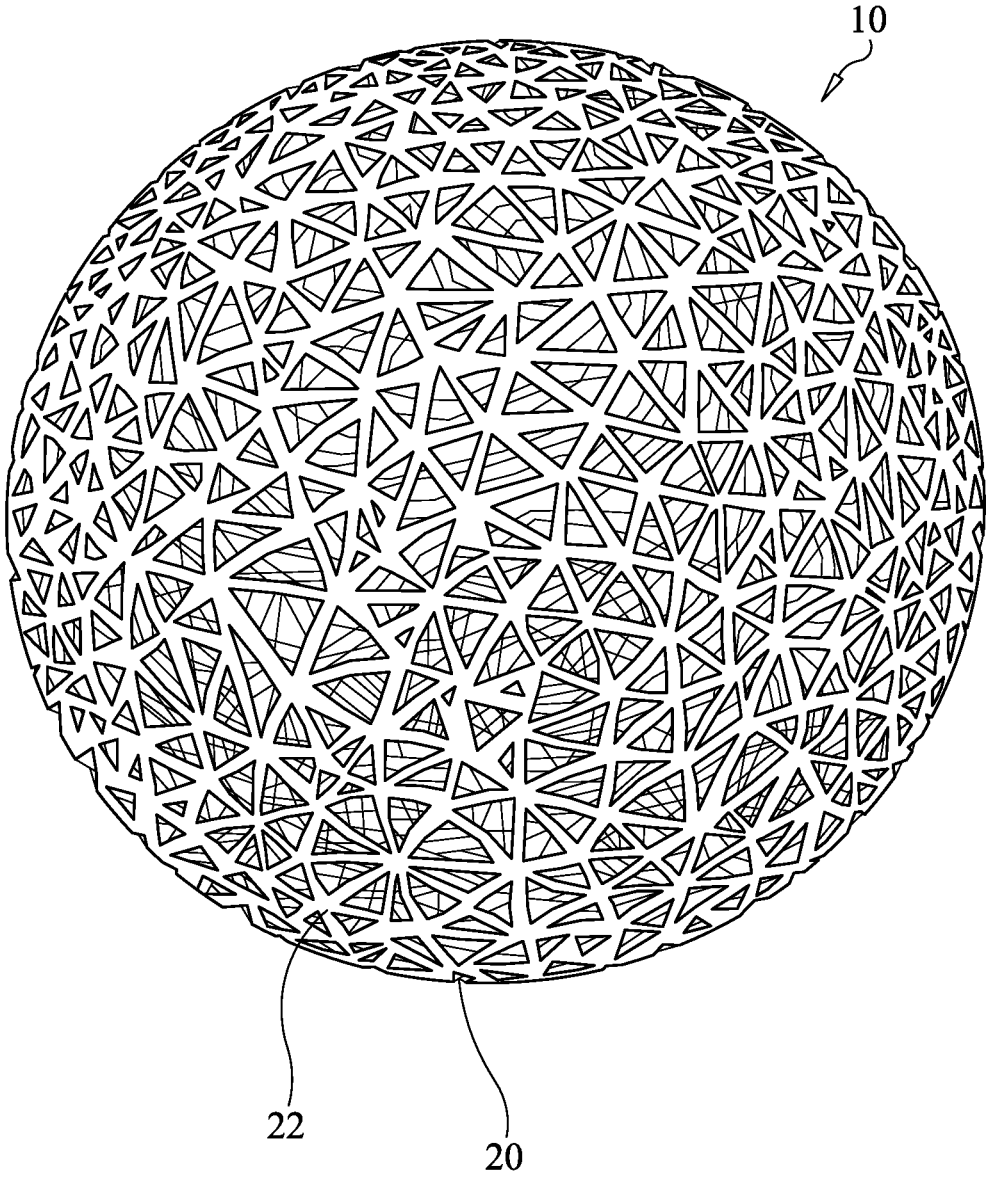
FIG. 4 is a perspective view of the top hemisphere portion of the surround, in accordance with an embodiment of the invention.
Figure 5:
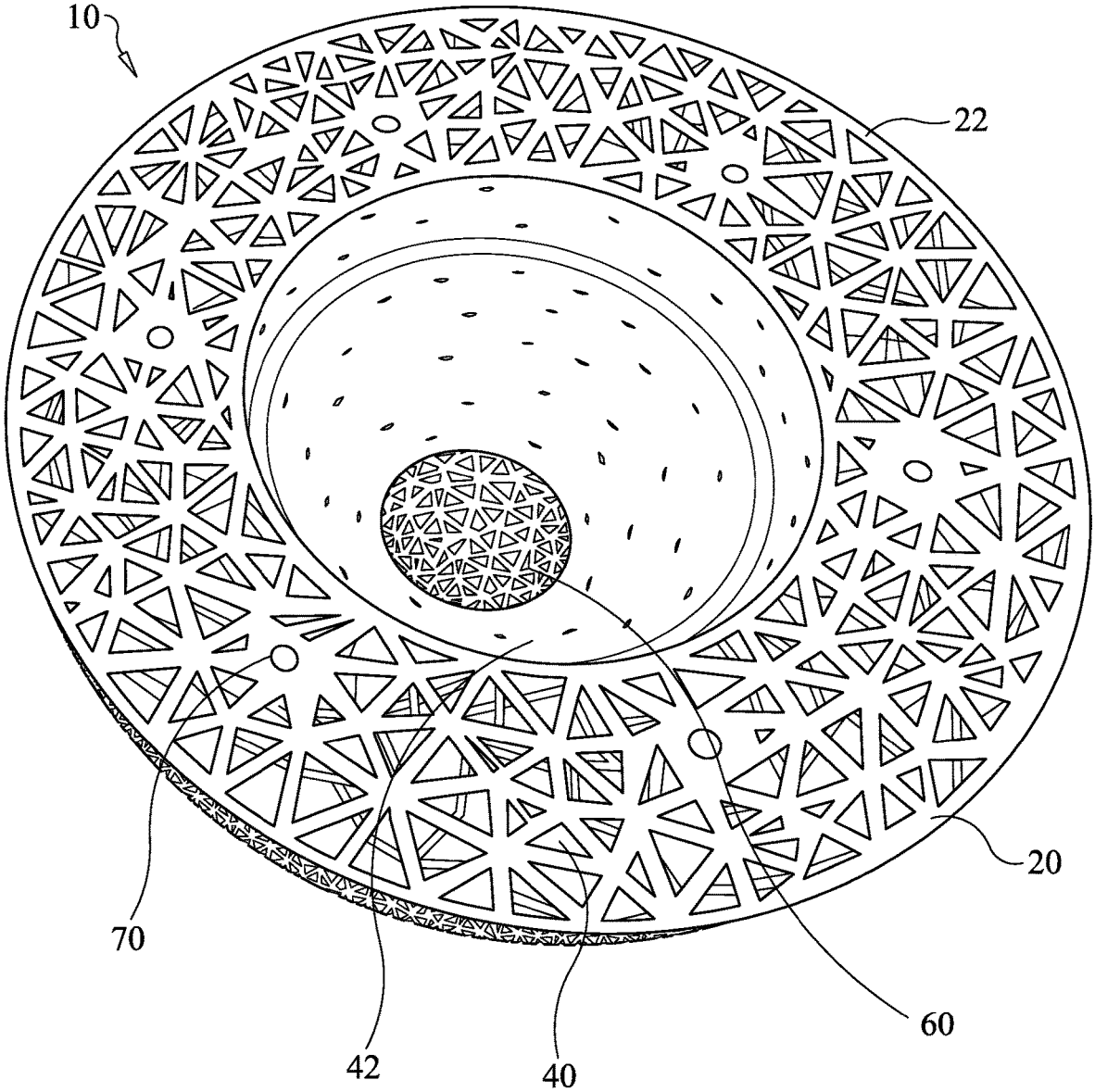
FIG. 5 is a perspective view of the bottom hemisphere portion of the surround.

With reference to FIGS. 2 and 4, the surround 10 may further comprise one or more chambers 60 for promoting the passage of acoustic signals between the outside and the acoustic device 12. The one or more chambers 60 are continuous with the interior 42 of the surround 10 which is defined by the liner 40. Therefore, the one or more chambers 60 can be understood to be substantially devoid of the lattice 44. The one or more chambers 60 promote the passage of acoustic signals because the chambers 60 are configured to be in close proximity to any acoustic and ultra-sonic transducers in the acoustic device 12, thus acoustic signals would need only to pass through a relatively thin layer of liner 40 and/or shell 20 material in order to move in or out of the surround 10.

The shell 20 and/or liner 40 may further comprise one or more ports 63 which penetrate directly into the one more chambers 60 from the outside. These ports 63 may additionally promote the movement of acoustic signals between the outside and the acoustic device 12.

With reference to FIG. 2, the surround 10 may further comprise one or more bands comprising continuous surfaces. In an embodiment, an outer band 62 may be provided around the outside perimeter of the shell 20 and can be configured to engage the surface of the pipeline and provide a smoother rolling surface for the surround 10 as the surround 10 rolls along the interior surface of the pipeline. When provided, the outer band 62 may be configured to provide a stable rolling action whereby the outer band 62 engages the surface of the pipeline and the surround 10 is caused to rotate about an axis (A) that is perpendicular to a set of substantially parallel planes intersecting the sphere defined by the outer band 62. In some embodiments, the outer band 62 may reduce the noise associated with skidding of the surround 10 along the interior surface of the pipeline.

In another embodiment, the surround may further comprise a retaining member 64 associated with the perimeter of an interior surface of the surround 10 and adjacent to the acoustic device 12. Retaining member 64 is provided for retaining the acoustic device in the surround. In additional embodiment, the member 64 may be an inner band 64 configured along the perimeter of an interior surface of the surround 10 and adjacent to the acoustic device 12. The outer 62, inner 64, or both bands 62, 64 may not be present in some embodiments, such as when the passage of sound is more critical, or a lower stiffness is desirable.

Figure 3:
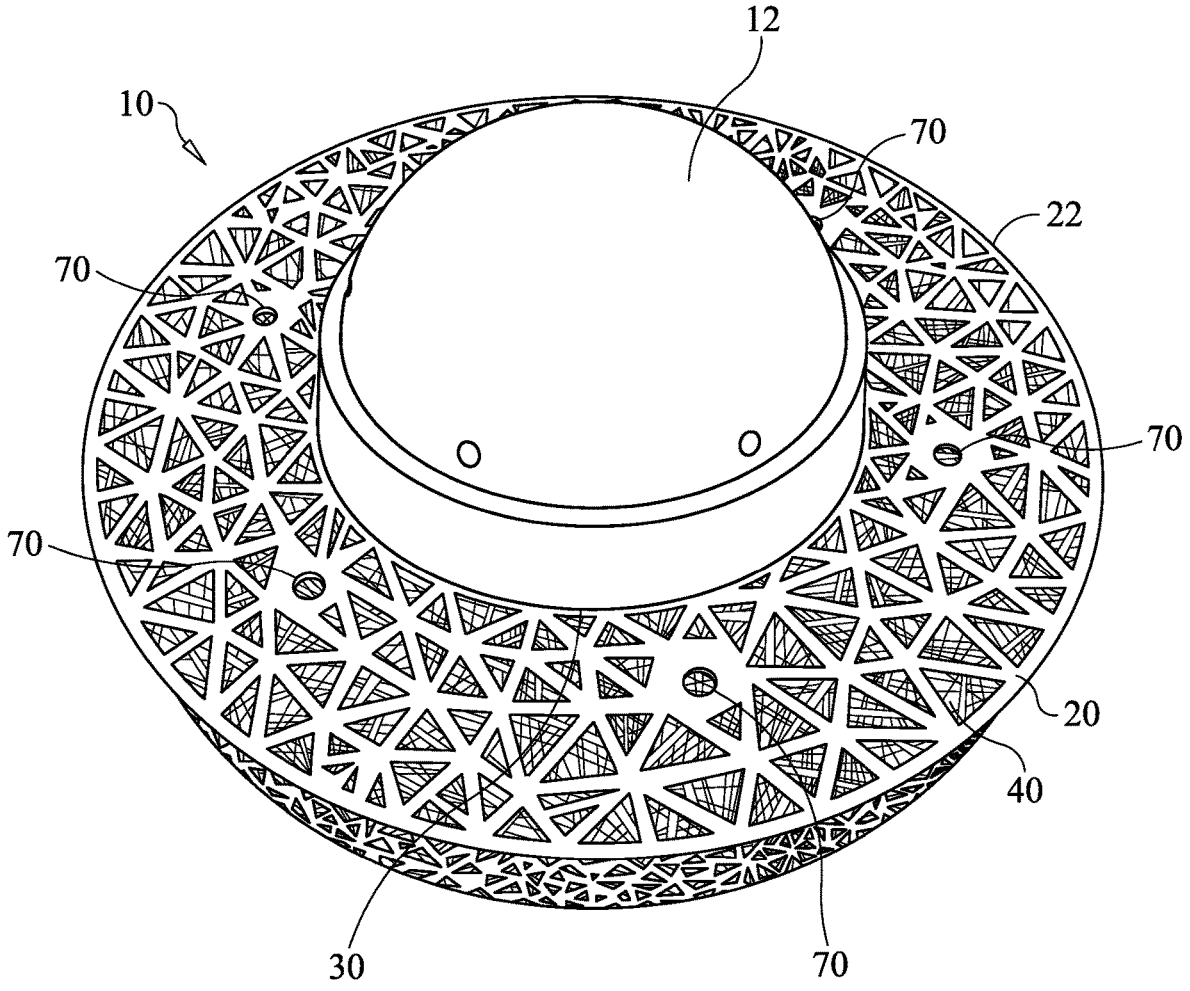
FIG. 3 is a perspective view of the surround, wherein a top hemisphere portion of the surround has been removed to reveal the internal structure of the surround and a pipeline inspection device contained in a bottom hemisphere portion of the surround, in accordance with an embodiment of the invention.

As shown in FIGS. 2, 3 and 4, the surround 10 can be formed by the reversible coupling of at least two complementary portions (or two halves). Each one of the portions can include an attachment means 70 configured to securely attach the complementary portions together after the acoustic device 12 has been inserted into the surround 10.

Exemplary attachment means 70 include integrated threading where male and female threads are integrated directly into one or more of the shell 20 and/or liner 40, so that the portions may be joined by twisting the portions together. The attachment means 70 may include conventional threaded fasteners comprising a screw and threaded insert or bolt and nut, or a combination of these. Other suitable attachment means 70 can include sewing the portions of the surround 10 together using metal, natural, or synthetic fibres. The construction of the surround 10 allows for sewing directly through the spaces between the shell 20 and the liner 40. Other suitable attachment means 70 can be push-in/pull-though retainers integrated into the surround 10. These retainers may rely on compliance of the retainer and/or the surround 10 to momentarily permit the retainer to pass into a hole during installation or removal and may require excess force or breakage of the retainer during removal. Another suitable attachment means includes bonding the pieces of the surround 10 together with the use of a solvent or adhesive.

Alternatively, the surround 10 can be in the form of a unitary construction whereby and the insertion of the acoustic device 12 can be accomplished through one or more self-closing apertures (not shown) that are configured to expand sufficiently to allow the insertion, but may sufficiently self-close following the insertion of the device 12 so as to preserve the smooth spherical shape of the surround 10.

According to another embodiment, the shell 20 and the liner 40 comprise an elastomeric material. In some embodiments, the shell 20 and liner 40 are comprised of the same elastomeric material. A suitable type of elastomeric material is polyurethane. Other suitable types of elastomeric materials include, thermoplastic polyurethane (TPU), synthetic rubbers, silicone, and other polymers.

According to another embodiment, the shell 20 and the liner 40 can be manufactured by fused filament fabrication methods (i.e. 3D printing).

The embodiments of the present application described above are intended to be examples only. Those of skill in the art may effect alterations, modifications and variations to the particular embodiments without departing from the intended scope of the present application. In particular, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole. Any dimensions provided in the drawings are provided for illustrative purposes only and are not intended to be limiting on the scope of the invention. The subject matter described herein and in the recited claims intends to cover and embrace all suitable changes in technology.

The invention claimed is:

1. A surround for protecting an acoustic device for sending and/or receiving acoustic signals positioned therein from impact as the surround is rolled along an interior surface of a fluid-containing pipeline, the surround comprising:

a shell comprising an exterior segment configured to roll along the interior surface, the exterior segment defining at least one acoustic aperture configured to allow the passage of acoustic signals therethrough; and a lattice configured between the exterior segment and the acoustic device, the lattice comprising a plurality of unit cells, each unit cell defining an opening, wherein the plurality of unit cells are interconnected and define a plurality of openings, wherein the plurality of openings allow fluid to move between the interior of the surround and the exterior of the surround and enable the passage of the acoustic signals transmitted and/or received by the acoustic device such that the surround reduces the diminution of the quality and/or strength of the acoustic signals.

2. The surround of claim 1 wherein the lattice includes an acoustic channel, the acoustic channel defined by a portion of interconnected unit cells and the alignment of a portion of the plurality of openings of the portion of interconnected unit cells, and wherein the acoustic channel is in substantial alignment with the acoustic aperture such that the acoustic signals transmitted by and/or received by the acoustic device can travel within the acoustic channel and through the acoustic aperture in a manner that is substantially unimpeded by any part of the surround.

3. The surround of claim 2 wherein the lattice is resiliently deformable upon application and then removal of the force.

4. The surround of claim 3 wherein the lattice is configured to provide a varying distribution of resistance to compression that increases moving outwards from near the center to the outer periphery of the surround.

5. The surround of claim 4 wherein the varying distribution of resistance to compression comprises: a decrease in distance separating the plurality of interconnected unit cells; a decrease in dimension of the opening of each unit cell; or an increased thickness of each unit cell, moving outwards from near the center to near the outer periphery of the surround.

6. The surround of claim 3 wherein each unit cell is formed from a plurality of filaments, the filaments arranged to define the opening of each unit cell.

7. The surround of claim 6 wherein the plurality of interconnected unit cells comprise a stacked arrangement of unit cells, the stacked arrangement of unit cells being configured to permit adjacent unit cells to resiliently move in relation to each other.

8. The surround of claim 7 wherein the plurality of interconnected unit cells comprise cubic edges, cubic diamonds, tetrahedron vertex centroids, or combinations thereof.

9. The surround of claim 8 further comprising band on the outer perimeter of the shell, the band configured to provide a continuous rolling surface for the surround.

10. The surround claim 8 wherein the shell further comprises an interior segment connected to the exterior segment and adjacent the acoustic device, and wherein the lattice is connected to the interior and exterior segments at the one or more interior attachment points.

11. The surround of claim 10 wherein the surround is formed by reversible coupling of at least two complementary portions, each one of the portions comprising attachment means configured to couple the complementary portions.

12. The surround of claim 11 wherein the attachment means is a screw and threaded insert, sewing, friction coupling, bonding, or combinations thereof.

13. The surround of claim 8 wherein the exterior segment comprises a plurality of interconnected beams.

14. The surround of claim 13 wherein the at least one acoustic aperture is defined by a group of the plurality of interconnected beams.

15. The surround of claim 14 wherein the plurality of interconnected beams are arranged as a tessellation of triangles.

16. The surround of claim 8 wherein the exterior segment is spherical, an ellipsoid, or an oblate or prolate spheroid.

* * * * *